US009920670B1

(12) United States Patent
Wright

(10) Patent No.: US 9,920,670 B1
(45) Date of Patent: Mar. 20, 2018

(54) MUFFLER FOR A POWERBOAT ENGINE

(71) Applicant: Byron Wright, Orofino, ID (US)

(72) Inventor: Byron Wright, Orofino, ID (US)

( * ) Notice: Subject to any disclaimer, the term of this patent is extended or adjusted under 35 U.S.C. 154(b) by 0 days.

(21) Appl. No.: 15/637,764

(22) Filed: Jun. 29, 2017

(51) Int. Cl.

| | |
|---|---|
| ***F01N 1/08*** | (2006.01) |
| ***F01N 13/08*** | (2010.01) |
| *F01N 1/00* | (2006.01) |
| *F01N 13/00* | (2010.01) |

(52) U.S. Cl.
CPC ..... *F01N 1/083* (2013.01)

(58) Field of Classification Search
CPC ... F01N 1/083; F01N 1/14; F01N 1/08; F01N 13/082; F01N 13/08; F01N 13/12; F01N 2590/02; F01N 2590/021; F01N 2590/022; F01N 2240/20; F01N 2470/16
See application file for complete search history.

(56) References Cited

U.S. PATENT DOCUMENTS 1,338,520 A * 4/1920 Moores ..... F01N 1/06 181/253
2,248,456 A * 7/1941 Huntington ..... F01N 1/02 181/262
3,191,714 A * 6/1965 Phillips ..... F01N 1/06 181/253
3,899,923 A * 8/1975 Teller ..... F01N 3/04 181/221
4,050,903 A * 9/1977 Bailey ..... F01N 3/2885 422/177
4,209,493 A * 6/1980 Olson ..... F01N 1/08 422/176
4,487,289 A * 12/1984 Kicinski ..... F01N 1/08 181/252

(Continued)

FOREIGN PATENT DOCUMENTS

DE 3206264 A1 * 10/1983 ..... F01N 13/082
GB 646384 A * 11/1950 ..... F01N 1/14

(Continued)

*Primary Examiner* — Edgardo San Martin
(74) *Attorney, Agent, or Firm* — Duncan Palmatier

(57) ABSTRACT

A powerboat muffler is disclosed that balances decreasing exhaust noise and producing power. A muffler cannister has concentric inlet tubes, forming an inlet baffle, where exhaust gas and engine coolant enters the muffler, a V-shaped baffle within the cannister, a funneled outlet, and concentric outlet tubes, forming an outlet baffle. The inlet baffle comprises concentric outer and inner tubes and the front wall of the muffler, which together form an toroidal inlet space. The inner inlet tube extends a certain distance into the muffler cannister. The inside wall of the inner inlet tube is shaped to create a venturi. Through the front wall, within the toroidal inlet space, small venturi-shaped openings are disposed radially between the outer and inner tubes to allow engine exhaust and coolant to enter the muffler. At the outlet end of the muffler, a tapered nozzle funnels exhaust to an outlet tube with a venturi contour. The outlet tube extends out from the outlet nozzle a certain distance. Surrounding and concentric with the outlet tube is an outer outlet tube. The outer outlet tube, the inner outlet tube and the outside surface of the outlet nozzle form another toroidal baffling space at the tail end of the muffler.

18 Claims, 5 Drawing Sheets

(56) References Cited

U.S. PATENT DOCUMENTS 4,574,914 A * 3/1986 Flugger ..... F01N 1/083 181/268
4,809,812 A * 3/1989 Flugger ..... F01N 1/083 181/265
4,825,652 A * 5/1989 Curran ..... F01N 3/021 181/264
5,058,704 A * 10/1991 Yu ..... F01N 1/089 181/262
5,444,197 A * 8/1995 Flugger ..... F01N 1/06 181/264
5,962,822 A * 10/1999 May ..... F01N 1/083 181/258
6,089,347 A * 7/2000 Flugger ..... F01N 1/003 181/264
6,286,623 B1 * 9/2001 Shaya ..... F01N 1/085 181/264
6,832,665 B2 * 12/2004 Crombeen ..... F01N 1/089 181/212
6,932,188 B2 * 8/2005 Ni ..... A47L 9/0081 15/326
7,845,465 B2 * 12/2010 Baumgartner ..... F01N 1/04 181/249
7,905,319 B2 * 3/2011 Sullivan ..... F01N 1/003 181/212
8,671,671 B1 * 3/2014 Spencer-Smith ..... F01N 13/082 60/324
9,188,048 B2 * 11/2015 Bedard ..... F01N 13/082
2014/0182961 A1 * 7/2014 Bedard ..... F01N 13/082 180/190

FOREIGN PATENT DOCUMENTS

GB 727209 A * 3/1955 ..... F01N 13/082
GB 923492 A * 4/1963 ..... F01N 1/14

* cited by examiner

MUFFLER FOR A POWERBOAT ENGINE

FIELD OF THE INVENTION

The present invention relates to an exhaust muffler for a powerboat. More specifically, the invention relates to the internal structure and baffling of a powerboat muffler.

BACKGROUND OF THE INVENTION

Designing efficient and effective mufflers for powerboats involves a number of problems. A powerboat muffler must reduce noise while not decreasing the engine's power. The need to reduce noise is especially important at lakes, where noise can be a nuisance and may be regulated by government agencies. Reducing noise, however, often results in restricting an engine's power output. Also, a significant problem in powerboats is space, since there is little room for large conventional mufflers, such as those used on cars. For example, some cars use more than one muffler. But, in comparison to many powerboats, cars afford sufficient room for a muffler, or mufflers, to dampen or attenuate the sound. This is not the case with powerboats, nor is it with motorcycles or ATVs. Without space to provide a muffler that can reduce noise without significantly decreasing power, it is hard to make an engine quiet, because there is not enough muffler volume available. It is possible to reduce noise by reducing the diameter of the muffler outlet, but there is a consequent power loss resulting from air flow restriction. The problem to solve is how to make a small muffler that attenuates the sound, as much as a larger muffler would, and do so without reducing the engine's power.

SUMMARY OF THE INVENTION

The present invention is a powerboat muffler with internal structures that reduce noise while maintaining adequate flow to enhance power production. A significant advantage of the present muffler design is its ability to decrease the engine's exhaust sound volume in comparison to conventional mufflers without reducing engine power or taking up any more space than conventional mufflers. By reducing noise, the invention reduces noise pollution, avoids harm to boater's ears, makes conversation between boat occupants easier, is less likely to scare off fish, and enhances water skiers' experience.

The muffler of the present invention is close in size to conventional powerboat mufflers, yet decreases exhaust noise while producing more power than conventional mufflers. A cylindrical muffler cannister has a baffled inlet into the cannister, a V-shaped baffle within the cannister, and a tapered outlet baffle. The engine's exhaust pipe joins an outer tube at the inlet end of the muffler. An inlet baffle is formed of concentric tubes: the outer tube joined to the exhaust pipe and an inner tube, within and concentric to the outer tube. The inner inlet tube extends into the exhaust pipe a certain distance from the inlet end of the muffler and enters and extends a certain distance into the muffler cannister. The inside wall of the inner inlet tube is shaped to create a venturi. A space, in the form of a rectangular toroid, is formed between the concentric outer and inner inlet tubes and plate, or wall, at the inlet-end of the muffler cannister. This arrangement uses a portion of the front wall of the muffler, between the outer inlet tube connected to the engine exhaust pipe and the inner tube, as a baffle to reduce exhaust noise. Also in this portion of the muffler's front wall are small holes, or openings, disposed radially between the outlet and inner tubes. These openings allow engine exhaust and coolant to enter the muffler cannister. In the preferred embodiment, these openings are shaped as venturis.

Within the cannister, a V-shaped baffle is positioned to divide the incoming exhaust into two channels. As exhaust travels through the muffler cannister, it passes between the wider end of the V-shaped baffle and the cannister's inner wall. After passing around the wider end of the V-shaped baffle, the exhaust reaches the outlet end of the muffler cannister. The outlet end of the muffler cannister is formed as a tapering cone-shaped nozzle. The exhaust travels through the outlet nozzle before reaching the outlet tube. The outlet tube extends out from the outlet nozzle a certain distance. The inside wall of the outlet tube has a venturi shape. Thus, the cone-shaped nozzle and outlet tube form a venturi at the muffler's outlet. Surrounding and concentric with the outlet tube is an outer outlet tube. The outer outlet tube is welded to the outside surface of the muffler's cone-shaped outlet nozzle. The outer outlet tube, the inner outlet tube and the outside surface of the muffler's nozzle form a baffling space, in the shape of a right toroid. This arrangement uses a portion of the muffler's nozzle, between the outer outlet tube connected to the exhaust tail pipe and the inner outlet tube, as another baffle to reduce exhaust noise. The outer outlet tube is joined to an exhaust tail pipe, from which the engine's exhaust gases and coolant is discharged.

As described below, this arrangement reduces noise without decreasing power and does so without using large amounts of space.

DETAILED DESCRIPTION

Figure 1:
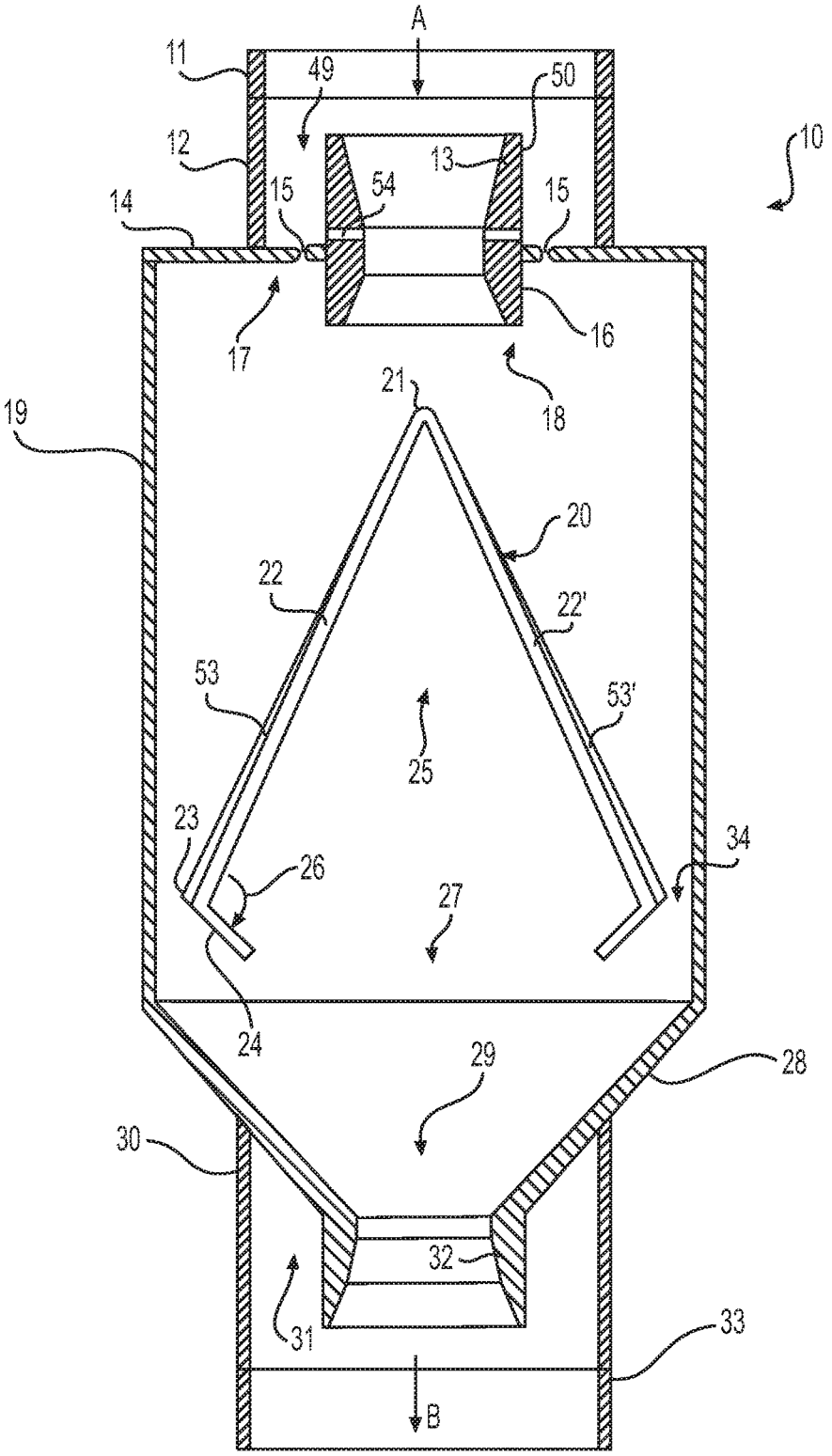
FIG. 1 is a side, cut-away view of a muffler of the present invention.
Figure 3:
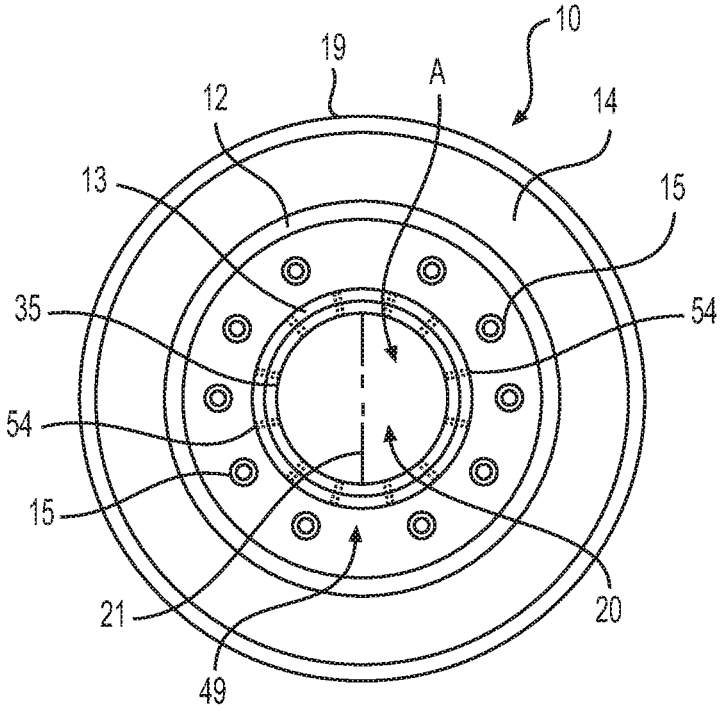
FIG. 3 is a front view of the muffler intake taken from the inlet end of the muffler looking at the muffler's front plate and into the muffler through the inlet tubes.
Figure 4:
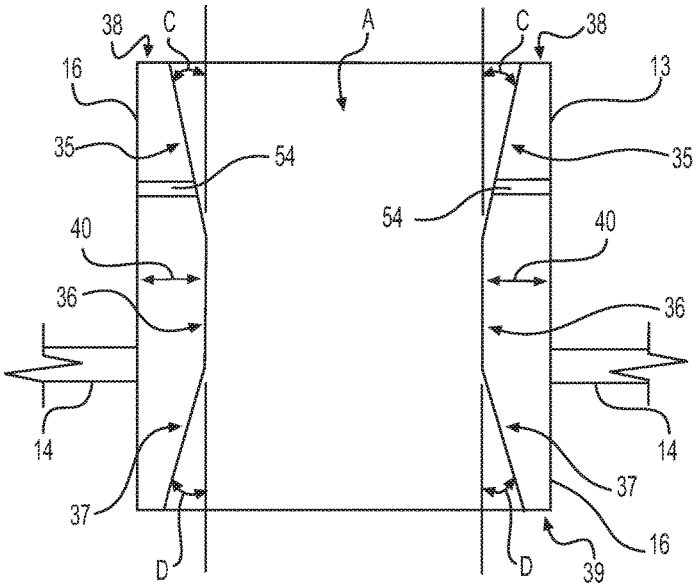
FIG. 4 is a side, cut-away view of the inner inlet tube.

Referring to FIG. 1, exhaust gases and coolant water from an engine's exhaust pipe or header 11 reach the muffler 10 through an inlet A. In the embodiment shown in FIG. 2, the muffler 10 is a cylindrical cannister housing 19, but other housing 19 shapes may be adopted. The cannister housing 19 has a cylindrical side wall, a front plate or wall 14 at a proximal, inlet end of the housing 19, an outlet cone 28 at the opposite, distal end of the housing 19, and an interior space forming a volume within the housing 19 side wall, front wall 14 and outlet cone 28. The disclosed embodiment shows a cylindrical cannister, but other substantially cylindrical shapes may be employed, such as oval cannister or even a rectangular or square cannister with rounded corners. A powerboat muffler may be constructed of aluminum, since engine cooling water is expelled with exhaust gases, thereby cooling the exhaust pipes. For this application, aluminum has the advantage of not rusting, a problem in boats. Alternatively, stainless steel may be used. For engines that do not use this marine cooling arrangement, metals capable of sustaining higher temperatures are suitable, such as stainless steel. For powerboat engines of about 350 cubic inches and 400 to 500 horsepower, a cylindrical cannister with a 6-inch diameter and 10-and-⅝-inch length is suitable. Exhaust manifolds and headers for such engines typically are joined at a collector that directs the exhaust and water into a pipe 4 inches in diameter. Different size engines will require different sizes of exhaust pipes and mufflers. As shown FIGS. 1 and 3, at the inlet A, concentric cylindrical tubes form outer 12 and inner 13 inlet tubes. The exhaust outer inlet tube 12, or flange, is joined with and of substantially the same diameter as the exhaust pipe 11, 4 inches in this embodiment, and surrounds the inner inlet tube 13 like the barbican of a castle. The inner inlet tube 13 has a diameter of 2½ inches and is 3-inches long. The inner inlet tube 13 has thickness 40 (shown in FIG. 4) of ⅛-inch. From the front or inlet-side wall or plate 14 of the muffler 10, a portion 50 of the inner inlet tube 13 extends 2 inches into the exhaust pipe 11. From the front plate 14, an inlet extension 16 of the inner inlet tube 13 extends 1 inch into the interior of the cannister 19. This arrangement provides a ratio of the cannister 19 length to the inlet extension 16 length of between about 11:1 and 7:1. As described below in connection with FIG. 4, the inner inlet tube 13 has a venturi contour. Between the 4-inch diameter outer inlet tube 12 and the 2½-inch diameter inner inlet tube 13 and the cannister's 11 front plate 14, an inlet space 49, in the form of a rectangular toroid, is created. On the front plate 14 within that inlet space 49, openings 15, arranged radially, allow exhaust to pass into the cannister 19. As described in more detail below in connection with FIG. 6, the inlet openings 15 have venturi-shapes. In a preferred embodiment, 10 venturi openings 15 may be arranged on the front plate 14 radially around the inlet space 49. In an alternative embodiment, small holes 54 are formed radially about the portion 50 of the inner inlet tube 13 to enhance flow and noise reduction. In FIG. 1, these radial holes 54 are shown disposed close (about ⅛") to the front plate 14, and in FIG. 4 the radial holes 54 are shown in an alternative position.

Reducing the inlet A from a 4-inch pipe 11 to a 2½-inch inner inlet tube 13 provides sound dampening. Sound waves are admitted into the muffler 10 almost entirely through the inner inlet tube 13. With that configuration, a reduction in area of 36% over the 4-inch pipe 11 is attained. Remaining sound waves in the exhaust pipe 11 are reflected back on themselves as they hit the front plate 14. This configuration, as previously mentioned, provides a measure of sound damping by creating a baffle.

The inner inlet tube 13 extends into the in-coming A gases a certain distance (2 inches in the example disclosed) from the front plate 14 back into the exhaust pipe 11. This distance was determined on a flow bench to produce the maximum amount of flow. Testing established that this inlet configuration added 50 Cubic Feet per Minute ("CFM") over an equivalent conventional muffler with a straight 4-inch tube. Another benefit of using this inlet configuration is an increase in the velocity of the gas and water entering the muffler cannister 19, helping to keep the water in suspension and prevent puddling.

The inner inlet tube 13 extends past the front plate 14 into the muffler cannister 19 a certain distance (1 inch in the disclosed embodiment). As high velocity gas exits the inner inlet tube 13, it creates a low-pressure zone on the front, exhaust pipe 11 side 49 of the front plate 14. The positive pressure zone on the front side 49 of the plate 14 and a negative pressure zone 17 on the back, cannister 19 side helps to pull the inlet A exhaust gases and coolant through the inlet venturis 15 in the front plate 15, which enhances the flow through the openings 15. The lengths, 50 and 16, of the inner inlet tube 13 into the exhaust pipe 11 (50) and into the cannister 19 (16) have been determined through testing to provide the best balance of negative pressure and exhaust/water flow. This also acts as an anti-reversion device preventing exhaust from going back upstream. As exhaust and sound waves come A through the inner inlet tube 13 with only a portion of the sound admitted, the exhaust speeds up and then exhaust and sound immediately expand in the larger cannister 19 space. Exhaust speed will slow in the larger space, which is desirable, because sound is dampened as it expands and loses energy and because exhaust will be turned to flow tangent to the side walls, 22 and 22', of a V-shaped baffle 20, discussed below.

Figure 6:
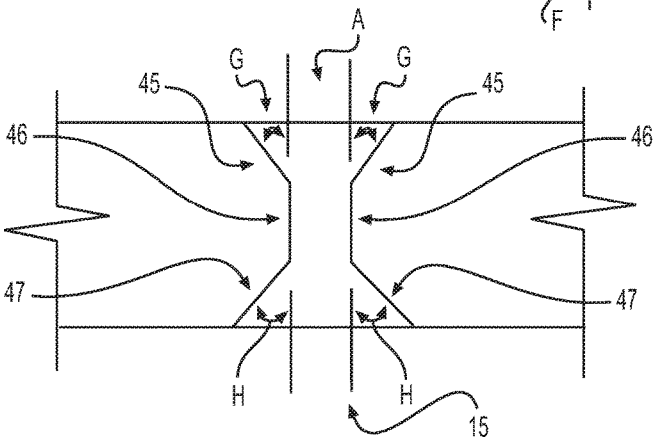
FIG. 6 is a side cut-away view of the front plate of the muffler cannister, highlighting one of the venturi-shaped openings between the inlet space and the interior of the cannister.

Referring to FIG. 6, in the preferred embodiment, the openings 15 are venturis, made by beveling the leading edge 45 with a converging angle G, followed by a straight section 46, and then beveling a diverging angle H into the trailing edge 47. The front plate 14 is ⅛-inch thick. The angle G of the leading edge 45 is 60-degrees and extends down into the opening 15 0.050 of an inch. The angle H of the trailing edge 47 is 82-degrees and extends up into the opening 15 0.050 of an inch. The length of the straight middle section 46 is 0.025 of an inch. The diameter of the middle section 46 is 7/64 inch of an inch (0.109"). The venturi shapes promote flow in the inlet direction A and discourage flow in the opposite direction, enhancing the anti-reversion property of the openings 15. Flow testing established that the venturi shape increases the flow through the openings by 8 CFM over straight holes. The venturi shape of the openings 15 limit the passage of sound, while allowing the flow of exhaust of a larger passage. The openings 15 have three purposes. The first two are providing drainage for the coolant water and relief of inlet A exhaust pressure between the exhaust pipe 11 and the inner inlet tube 13. The third purpose of the openings 15 is to reduce exhaust noise. The venturi-shaped openings 15 act as mini reflectors; when sound waves hit the beveled entry 45 and travel down to the narrower middle 46, they reflect along the cone-shaped length and dampen the sound.

Figure 2:
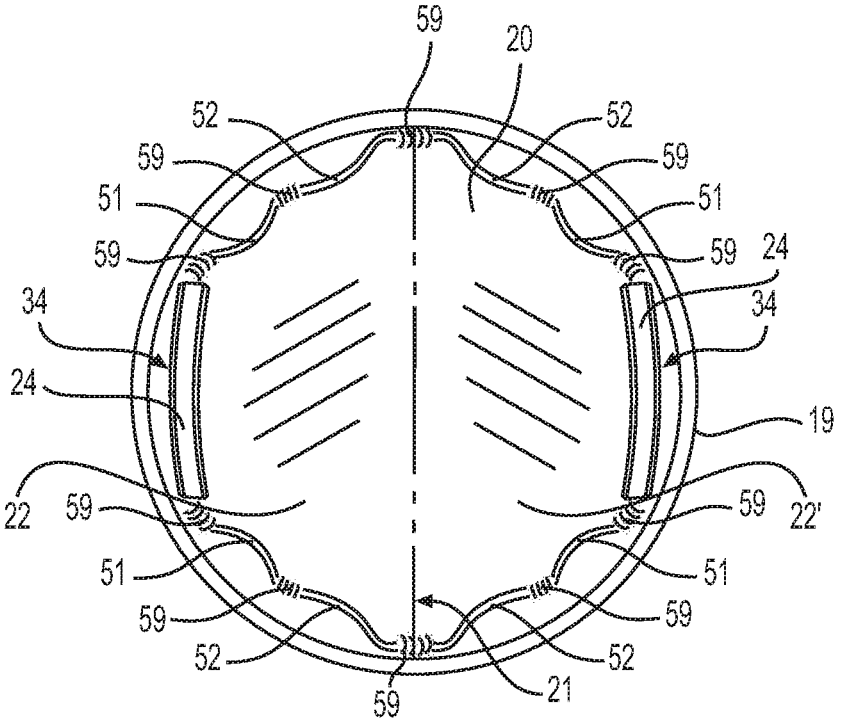
FIG. 2 is a cut-away view of the muffler cannister taken from the inlet end of the muffler looking into the muffler at the narrow end of the V-shaped baffle.
Figure 7A:
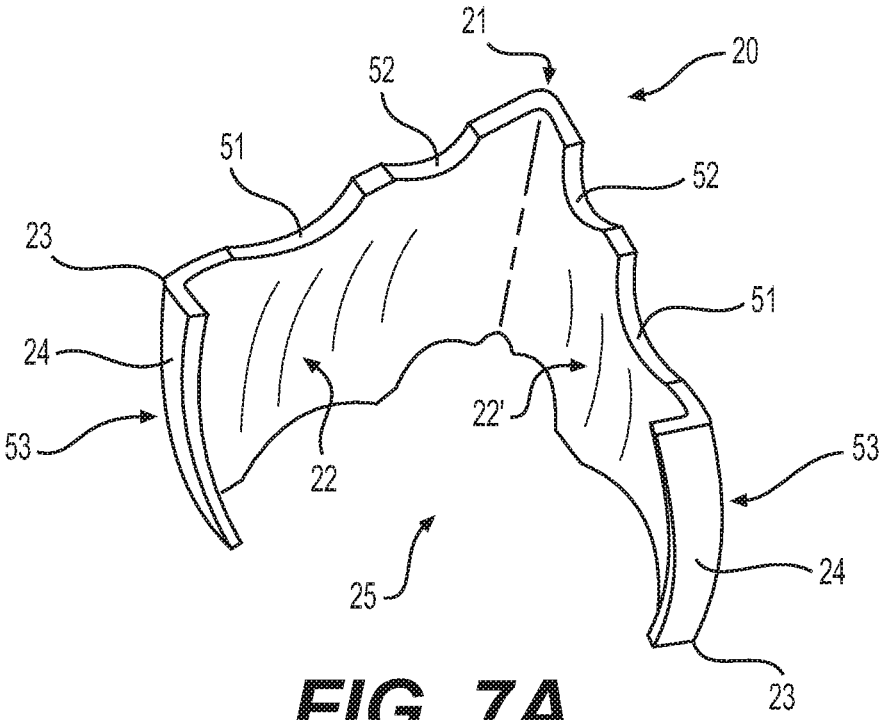
FIG. 7A is a three-quarter view of the V-shaped baffle.
Figure 7B:
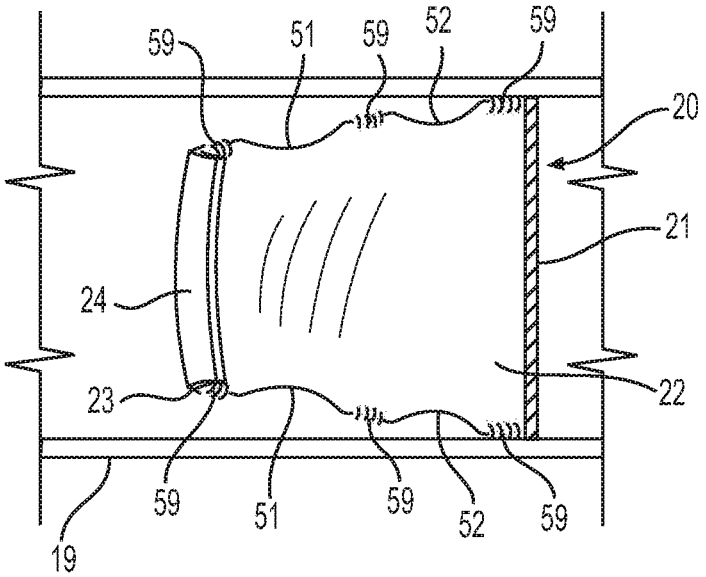
FIG. 7B is a side cut-away view of the muffler cannister showing a side view of the V-shaped baffle.

Referring to FIGS. 1, 2, 7A and 7B, the V-shaped baffle 20 resides within the muffler cannister 19, with the tip 21, or leading edge of the V facing the incoming exhaust A, and the spread sides, 22 and 22', extending toward the outlet B, forming an inner baffle space 25 within the interior of the baffle's sides, 22 and 22'. As shown in FIGS. 2 and 7B, the V-shaped baffle 20 is as wide at the tip 21 as the cannister's 19 diameter and has tapered sides, 22 and 22', to allow those sides to spread from each other within the cylindrical cannister 19. The V-shaped baffle 20 side walls, 22 and 22', are slightly curved outward to form a bow 53 shape that further enhance noise reduction. At the distal end 23 from the tip 21, the sides 22 and 22' bend inward by an angle 26 and form short straight sections 24. In the exemplary embodiment described, the inner diameter of the 6-inch muffler cannister 19 is 5¾ inches, so the tip 21 of the baffle 20 is 5¾ inches wide. The distal ends 23 of sides 22 and 22' are 3½ inches wide. The angle 26 at which the short sections 24 turn in is 131 degrees and each short section is ½ an inch long. As seen in FIG. 2, between the distal ends 23 of sides 22 and 22' and the inner wall of the cannister 19, D-shaped passages 34 are formed through which exhaust gas and water flows. The distance from the center of each baffle end 23 and the inner wall of the cannister 19 is about 0.600 of an inch.

As exhaust gases and coolant water leave the inner inlet tube 13, the tip 21 of the V-shaped baffle 20 splits the exhaust between the baffle's sides, 22 and 22', and the exhaust is presented with converging spaces between the baffle sides, 22 and 22', and the inner wall of the cannister 19. As the exhaust travels down the cannister 19, it is presented with smaller and smaller spaces created by the converging sides, 22 and 22', and the inside wall of the cannister 19, the exhaust has to speed up in order to pass through the D-shaped passages 34. This increases the exhaust's kinetic energy, which helps keep and pick up water as it passes through the small D-shaped passages 34.

As best seen in FIGS. 2, 7A and 7B, the sides 22 and 22' of the baffle 20 have edges that are contoured so that passages, 51 and 52, which may vary in size, are created along its length, allowing communication between both sides, 22 and 22', and the baffle's inner space 25. In a preferred embodiment, the first passage 52 is an 1¾ inch long arc that starts about 2 inches from the baffle's tip 21 and extends away from the inner wall of the cannister, at its highest, about 0.040 of an inch. A second passage 51 is a 3 inch long arc that starts about 5 inches from the baffle's tip 21 and extends away from the inner wall of the cannister, at its highest, about 0.070 of an inch. The communication passages, 51 and 52, provide two benefits. First they allow pressure to be bled off from the converging sections. Second, they help reintroduce water that has dropped out of suspension as it exits the inlet tube 13 into the large interior of the cannister 19. Water travels down the inside area 25 of the baffle where it is picked up and reintroduced by the nozzle section 29 of the outlet B.

As sound waves pass through the inlet A, they are presented with the two diverging sides, 22 and 22', of the V-shaped baffle 20 and are reflected all along the length of the converging spaces between the side walls, 22 and 22', and the inner wall of the cannister 19. As the sound waves reflect upon themselves, traveling back up the muffler toward the front plate 14, they face an increase in area and lose more energy, thereby helping to reduce noise. Sound waves that make it back to the inlet A end of the muffler 10, reach the back area 17 of the front plate 14 and are reflected into the converging sections of the baffle 20 where the process is repeated. As with the exhaust gases and water, sound waves are also inhibited from traveling back toward the engine by the extension 16 of the inlet tube 13 past the front plate 14. This extension 16 of the inner inlet tube 13 into the interior of the muffler 10 provides another area of baffling, where positive pressure waves approach the back area 17. Moreover, in a preferred embodiment, the V-shaped baffle 20 does not have straight sides, 22 and 22', but has sides, 22 and 22', that are slightly bowed out 53 toward to the inner wall of the cannister 19. The muffler 10, since it is round, and the sides, 22 and 22', since they are slightly bowed out 53, present to the sound waves and to the exhaust gas parabolic shapes that further reduce the amplitude of the sound.

The short straight sections 24 added at the ends 23 of each side, 22 and 22', of the baffle 20 provide five benefits. First, they create another venturi to assist the passage of exhaust gases and water through the D-shaped passages 34. Second, they help direct the exhaust into the next large section area 27 in a controlled manner. The transition from the small passages 34 to large section area 27 is smoothed, which helps to keep the exhaust gas and water flow more laminar, thereby making the flow more efficient. Thirdly, the high velocity created by the D-shaped passages 34 produces a negative pressure zone 25 at the inside of the V-shaped baffle 20 and helps to pull coolant water, that has dropped out of suspension, into the air stream. Fourthly, by allowing only a small portion of the sound into the last section 29 of the muffler 10, the majority of the sound is dampened within the main body of the cannister 19. Finally, the inner walls of the baffle sides, 22 and 22', act as two sound reflectors working in conjunction with the outlet nozzle section 29.

The outlet nozzle 29 is formed at the outlet B end of the muffler cannister 19. The outlet nozzle 29 is substantially in the shape of a funnel or cone 28. In the disclosed embodiment, the cone 28 narrows from the 6-inch diameter of the cannister 19 to a 2¼-inch diameter stem or outlet tube 32. The length of the cone 28 from the wider 6-inch diameter end to the narrower 2¼-inch diameter end is 2.0 inches. At the narrower end, a 2¼-inch outlet tube 32 extends 1³⁄₁₆ inches (1.188") beyond the end of the nozzle's cone 28. Concentric with the outlet tube 32 is an outer outlet tube 30, which is joined (by welding) about the outer surface of the nozzle cone 28 and extends toward the outlet B at least as far as the inner outlet tube 30. In the disclosed embodiment, the outer outlet tube 30 is 4 inches in diameter and sized to be joined with an exhaust tail or end pipe 33. An outlet space 31, in the shape of a right trapezoidal toroid, is formed between the inner outlet tube 32, the outer outlet tube 30, and the nozzle cone 28. This outlet space 31 is open to the outlet B at the tail pipe 33.

Figure 5:
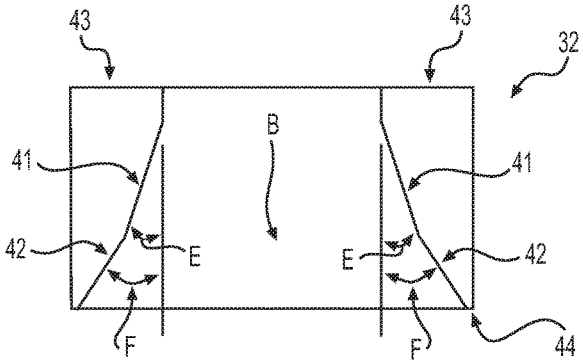
FIG. 5 is a side, cut-away view of the outlet inner tube.

The inner outlet tube 32 includes a multi-angled venturi contour in its inside surface, shown in detail in FIG. 5. The inner outlet tube 32 is ⅛ of an inch thick 43. Where it joins the nozzle cone 28, the inside wall of inner outlet tube 32 extends parallel to the axis of the cannister 19, then turns outward at an angle E of 4 degrees from the axial direction for a distance 41 of ⅝ of an inch (0.625"), and then turns further outward at an angle F of 6 degrees from the axial direction for a distance 42 of 0.325 of an inch. Nearest the exhaust tail pipe 33, the end 44 of the inner outlet tube 32 has a thickness of 0.080 of an inch.

As exhaust enters the outlet cone 28 at high velocity, it must turn twice and head toward the outlet B, where it reaches a larger area and slows. The converging shape of the cone 28 helps direct the flow to the outlet B. The cone 28 and inner outlet tube 32 create a nozzle 29. When the exhaust gases and water pass through the inner outlet tube 32 they emerge into the 4-inch exhaust tail pipe 33 and expand, losing velocity as they continue toward the exit into the atmosphere. This expansion provides additional sound attenuation.

As the sound reaches the outlet cone 28 it enters the largest area, a chamber formed at 25 and 29, and is presented with two opposing shapes. One is a cone 28 the other is the inner space 25 created within the side walls, 22 and 22', of the V-shaped baffle 20. As sound enters this chamber, 25 and 29, it expands to the greatest degree. This greatest degree of expansion provides the greatest dampening, such as the atmosphere ultimately provides. The sound waves rebound from the short cone 28 to the chamber, 25 and 29.

The sound entered the muffler through the 2½-inch inner inlet tube 13 and exits through the 2¼-inch inner outlet tube 32. The smaller outlet 32 provides another measure of damping. Upon exiting the 2¼-inch outlet tube 32, the exhaust expands again into the 4-inch exhaust end pipe 33, losing energy again and providing another point of sound damping and attenuation.

Integrated with the muffler nozzle 29 is an outlet space 31, in the shape of a right trapezoidal toroid, formed between the inner outlet tube 32, the outer outlet tube 30, and the nozzle cone 28. Utilizing the outside of the outlet cone 28 inherently provides multi-reflection points. The space 31 created between the inner outlet tube 32 and the outer outlet tube 30 creates another baffle, but not just a straight-walled baffle like at the inlet space 49. The backside of the cone 28 and the walls of the outer outlet tube 30 and the inner outlet tube 32 provide the sound damping space 31. The space 31 has two functions. First, it provides a baffle, trapping the sound in this baffle, which then is reflected. Second, the space 31 also provides a measure of anti-reversion. If the exhaust gases and water and sound waves try to travel back up the muffler 10, they will be baffled with the outlet tube's 32 a 2¼-inch opening.

Figure 8:
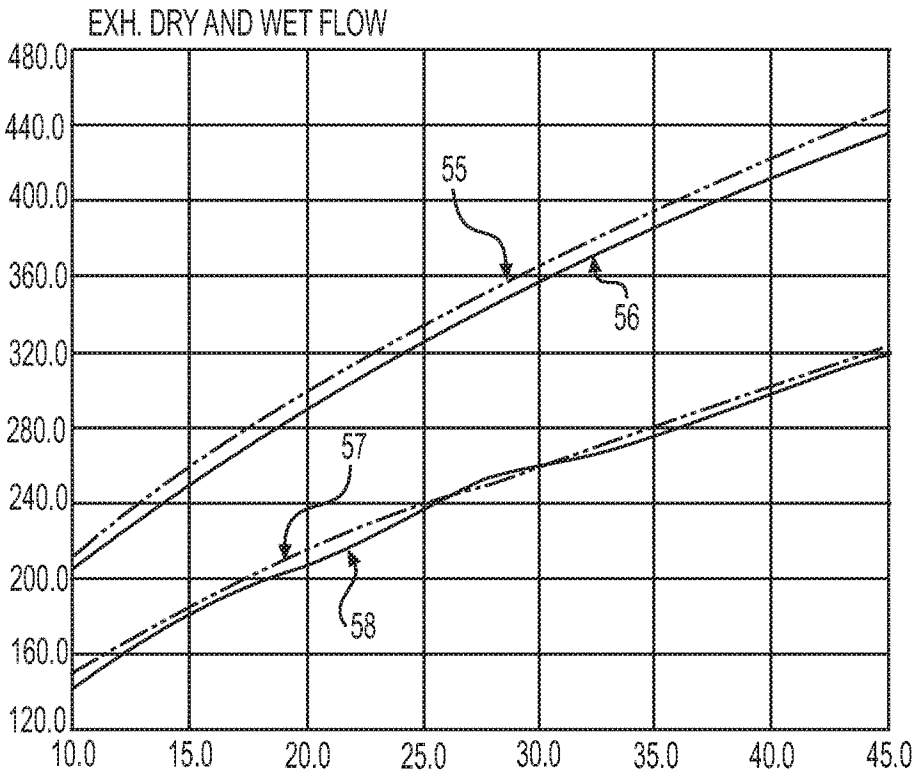
FIG. 8 is a graph showing flow bench test results for a muffler of the present invention and an equivalent conventional muffler.

FIG. 8 is a graph showing measured flow of a powerboat muffler of the present invention and the flow of an equivalent conventional muffler. The wet flow 55 and dry flow 56 of the muffler of the present invention are almost double an equivalent conventional muffler's wet 57 and dry 58 flows.

The drawings and description set forth here represent only some embodiments of the invention. After considering these, skilled persons will understand that there are many ways to make a powerboat muffler according to the principles disclosed. The inventor contemplates that the use of alternative structures, materials, or manufacturing techniques, which result in a powerboat muffler according to the principles disclosed, will be within the scope of the invention.

I claim:

1. A muffler for a powerboat engine comprising:

a muffler housing having a side wall, an inlet end, an outlet end, a front wall at the inlet end, an outlet wall at the outlet end, and an interior space defined by the side wall, front wall and outlet wall, wherein the front wall has an exhaust inlet opening and the outlet wall has an exhaust outlet opening, an outer inlet tube joined to the front wall and extending from the front wall in a direction away from the outlet end of the muffler housing, wherein the outer inlet tube is sized for connection to an exhaust pipe and further has an outer inlet tube cross section area, an inner inlet tube having an engine exhaust pipe end, a muffler end, an inner inlet tube length between the engine exhaust pipe end and the muffler end, an inner inlet tube outside surface along the inlet inner tube length, an inner inlet tube inside surface along the inner inlet tube length, and an inner inlet tube cross section area smaller than the outer inlet tube cross section area, wherein the exhaust inlet opening of the front wall is sized for the inner inlet tube cross section to receive the inner inlet tube length, and wherein a muffler portion of the inner inlet tube length extends from the front wall into the interior space of the muffler housing, and wherein an exhaust portion of the inner inlet tube length extends from the front wall into the outer inlet tube, an inlet space formed between the outer inlet tube, the inner inlet tube outside surface at the exhaust pipe portion of the inner inlet tube, and a front wall portion between the outer inlet tube and inner inlet tube outside surface, wherein the front wall portion further comprises a plurality of front wall apertures between the inlet space and the interior space of the muffler housing, a baffle arranged in the interior space between the front wall and the outlet wall, and an outlet tube having an outlet tube muffler end, an outlet tube tail end opposite the outlet tube muffler end, and an outlet tube cross section at the outlet tube muffler end, wherein the exhaust outlet opening of the outlet wall is sized for the outlet tube.

2. The muffler of claim 1 wherein the inner inlet tube inside surface forms a venturi along the inner inlet tube length.

3. The muffler of claim 2 wherein the plurality of front wall apertures form venturis between the inlet space and the interior space of the muffler housing.

4. The muffler of claim 3 further comprising:

an outer outlet tube joined to the outlet wall and extending from the outlet wall in a direction opposite the inlet end of the muffler housing, wherein the outer outlet tube has an outer outlet tube cross section area, wherein the outlet tube further comprises an outlet tube length and an outlet tube inside surface along the outlet tube length, wherein the outlet tube cross section area is smaller than the outer outlet tube cross section area, and wherein an exhaust portion of the outlet tube length extends from the exhaust outlet wall in the direction opposite the inlet end of the muffler housing, and an outlet space formed between the outer outlet tube, the outlet tube, and an outlet wall portion between the outer outlet tube and the outlet tube.

5. The muffler of claim 4 wherein the outlet wall forms a cone having a cone base joined to the outlet end of the muffler housing and narrowing to the exhaust outlet opening.

6. The muffler of claim 5 wherein the outlet tube cross section is smaller than a cross section of the outlet tube tail end.

7. The muffler of claim 6 wherein the baffle is V-shaped with a baffle tip and sides projecting down and outwardly from the baffle tip to bottom edges, wherein the baffle tip is directed toward the exhaust inlet opening and the baffle sides extend from the tip in a direction toward the exhaust outlet opening, wherein the baffle tip has a baffle width substantially equivalent to a housing width of the interior space of the muffler housing, and wherein a baffle outlet slit is formed between the bottom edges of the baffle sides and the side walls of the muffler housing.

8. The muffler of claim 7 wherein the sides of the V-shaped baffle have side edges extending from the tip to the bottom edge of each side, and wherein side edge portions of the side edges are fixed to the side walls of the muffler housing, and wherein at least one side edge has a side edge gap between the side edge and the side wall of the muffler housing.

9. The muffler of claim 7 wherein the bottom edges of the baffle sides further comprise baffle ends bent inwardly at an angle.

10. The muffler of claim 7 wherein the baffle sides form convexly bowed baffle surfaces.

11. The muffler of claim 1 wherein the engine exhaust pipe end of the inner inlet tube further comprises a plurality of passages allowing communication of exhaust between the inlet space and an inner inlet tube throat within the inner inlet tube inside surface along the inner inlet tube length.

12. An engine muffler comprising:

a cannister having an inlet wall at a proximal end of the cannister, an outlet funnel at a distal end of the cannister, a substantially cylindrical side wall between the proximal and distal ends, an interior volume formed within the side wall between the proximal and distal ends, an inlet opening in the inlet wall for admission of exhaust from an engine, an exhaust pipe flange on the inlet wall surrounding the inlet opening and extending from the inlet wall to join with an exhaust pipe from the engine, an outlet opening at a narrow stem of the outlet funnel to discharge exhaust from the interior volume, and a tail pipe flange on a tapered side of the outlet funnel and extending away from the interior volume, an inlet tube extending through the inlet opening, the inlet tube having a inlet tube length, an inner contour, a pipe portion, a mid portion, and a cannister portion, wherein the inlet tube is joined to the inlet opening proximate to the mid portion, the pipe portion extends away from the inlet wall into the exhaust pipe flange, and the cannister portion extends from the inlet wall into the interior volume of the cannister, and wherein a mid-portion diameter at the mid portion is less than a pipe-portion diameter at the pipe portion and the mid-portion diameter is less than a cannister-portion diameter at the cannister portion, an inlet toroidal baffle area formed between the exhaust pipe flange, inlet wall, and pipe portion of the inlet tube, and wherein the inlet toroidal baffle area further comprises inlet venturis in the inlet wall to allow communication of exhaust between the inlet toroidal baffle area and the interior volume of the cannister, an outlet tube having a muffler end, a tail end, and an outlet tube length from the muffler end to the tail end, wherein the muffler end is joined to the outlet opening and the tail end extends away from the outlet opening away from the interior volume of the cannister, and wherein a muffler-end diameter at the muffler end of the outlet tube is less than a tail-end diameter at the tail end of the outlet tube, and an outlet toroidal baffle area formed between the tail pipe flange, tapered side of the outlet funnel, and outlet tube.

13. The engine muffler of claim 12 wherein the side wall between the proximal and distal ends of the cannister has a cannister length, the cannister portion of the inlet tube has a cannister portion length, and a ratio of the cannister length to the cannister portion length is between 11:1 and 7:1.

14. The muffler of claim 13 wherein the pipe portion of the inlet tube further comprises a plurality of pipe portion passages disposed radially at an angle normal to the inlet tube length.

15. The muffler of claim 12 further comprising a V-shaped baffle having a leading edge and a pair of trailing walls extending at a baffle angle from the leading edge to outlet ends, wherein the V-shaped baffle is disposed within the interior volume of the cannister and oriented so that the leading edge is proximate to the cannister portion of the inlet tube and the outlet ends are proximate to the outlet funnel, and wherein a baffle exhaust passage is formed between the outlet ends and the side wall of the cannister.

16. The muffler of claim 15 wherein the trailing walls of the V-shaped baffle have wall edges extending from the leading edge to the outlet ends, and wherein at least one wall edge has a gap between the wall edge and the side wall of the cannister.

17. The muffler of claim 16 wherein the outlet ends of the trailing walls further comprise baffle flaps bent inwardly.

18. The muffler of claim 15 wherein the trailing walls have wall surfaces curved outwardly toward the side wall of the cannister.

* * * * *